US007316179B2

(12) United States Patent
Geberzahn et al.

(10) Patent No.: US 7,316,179 B2
(45) Date of Patent: Jan. 8, 2008

(54) CARRIER SYSTEM FOR PRODUCTS TO BE COOKED IN A BAKING OVEN

(75) Inventors: Markus Geberzahn, Hadamar (DE); Peter Bayles, Northampton (GB)

(73) Assignee: Accuride International GmbH, Diez (DE)

( * ) Notice: Subject to any disclaimer, the term of this patent is extended or adjusted under 35 U.S.C. 154(b) by 13 days.

(21) Appl. No.: 10/399,460

(22) PCT Filed: Sep. 4, 2001

(86) PCT No.: PCT/EP01/10148

§ 371 (c)(1),
(2), (4) Date: Apr. 15, 2003

(87) PCT Pub. No.: WO02/33325

PCT Pub. Date: Apr. 25, 2002

(65) Prior Publication Data

US 2004/0003726 A1 Jan. 8, 2004

(30) Foreign Application Priority Data

Oct. 16, 2000 (DE) ..... 100 51 153

(51) Int. Cl.
*F24C 15/16* (2006.01)

(52) U.S. Cl. ..... 99/340; 99/448; 99/450; 126/339; 312/330.1

(58) Field of Classification Search ..... 99/330, 99/339, 340, 352–355, 443 C, 443 R, 426, 99/427, 419–421 V, 444–450, 483; 219/400, 219/401, 492, 390, 411, 398; 126/337 R, 126/339, 20, 21 A, 41 R, 9 R, 200; 312/330.1
See application file for complete search history.

(56) References Cited

U.S. PATENT DOCUMENTS 3,791,371 A 2/1974 Oatley (Continued)

FOREIGN PATENT DOCUMENTS

DE 2036863 7/1970
DE 7412673 10/1975
DE 381 5 440 A1 5/1988

(Continued)

*Primary Examiner*—Timothy F Simone
(74) *Attorney, Agent, or Firm*—Paul & Paul

(57) ABSTRACT

The invention relates to a carrier system for products to be cooked in a baking oven. Said system comprises at least one carrier for products to be cooked (5), at least one pair of telescoping slides (6) which respectively comprise at least one inner rail (6*a*) and one outer rail (6*b*), and fixing devices which are arranged on the lateral walls (1*a*) of the baking oven muffle (1) and which enable the telescoping slides (6) to be detachably fixed at various levels of said baking oven muffle (1). Said carrier for products to be cooked (5) is positioned in such a way that it can be removed from the baking oven muffle by means of the telescoping slides situated in the same. The aim of the invention is to create a carrier system for products to be cooked, whereby only the minimum number of telescoping slides required is provided in the baking oven, thus enabling the carrier for products to be cooked to be moved between levels in a simple and comfortable manner without entailing complex dismounting work, and the telescoping slides are less easily dirtied and are exposed to less heat over a long period of term compared with known carrier systems for products to be cooked. In order to achieve this, the carrier for products to be cooked (5) is connected to the pair of telescoping slides (6) in a fixed or detachable manner in the form of a carrier unit for products to be cooked, which can be removed from the baking oven. Intermediate walls (2, 2') are provided in the baking oven muffle (1), said walls extending essentially perpendicularly in relation to the rear wall of the muffle (1*b*) in the direction of the muffle opening, and being arranged in such a way that the telescoping slides (6) respectively extend between the lateral wall of the muffle (1*a*) and the intermediate wall (2, 2') (cold area), and the carrier for the products to be cooked (5) extends between the intermediate walls (2, 2') (hot area), when the carrier unit for the products to be cooked and inserted into the baking oven.

12 Claims, 10 Drawing Sheets

U.S. PATENT DOCUMENTS

| | | | | | |
|---|---|---|---|---|---|
| 4,357,522 | A | * | 11/1982 | Husslein et al. | 219/400 |
| 5,299,557 | A | * | 4/1994 | Braithwaite et al. | 126/299 R |
| 5,746,118 | A | * | 5/1998 | Brunner et al. | 99/427 |
| 5,768,982 | A | * | 6/1998 | Violi et al. | 99/476 |
| 6,112,916 | A | * | 9/2000 | Barnes et al. | 211/153 |
| 6,318,245 | B1 | * | 11/2001 | Durth et al. | 99/330 |
| 6,789,861 | B1 | * | 9/2004 | Dobberstein | 312/330.1 |

FOREIGN PATENT DOCUMENTS

| | | | | |
|---|---|---|---|---|
| DE | 198 17 499 | C1 | | 4/1998 |
| DE | 198 59 986 | A1 | | 12/1998 |
| DE | 199 51 267 | A1 | | 10/1999 |
| EP | 0 407 742 | A2 | | 6/1990 |
| GB | 1 506 162 | | | 5/1978 |
| GB | 2196109 | A | * | 4/1988 |

* cited by examiner

CARRIER SYSTEM FOR PRODUCTS TO BE COOKED IN A BAKING OVEN

This application which is filed under 35 U.S.C. 371 is the National Stage of International Application Number PCT/EP01/10148 filed Sep. 4, 2001 which claims priority to German Patent Application DE10051153.8 filed Oct. 16, 2000.

The invention relates to a carrier system for products to be cooked in a baking oven, with at least one carrier for products to be cooked, at least one pair of telescopic guides which each have at least one inner rail and one outer rail, and fixing devices which are arranged on the side walls of the baking-oven muffle, and which are designed for a detachable fixing of the telescopic guides at various levels of the baking-oven muffle, the carrier for products to be cooked being positioned in such a way that it can be removed from the baking-oven muffle by means of the telescopic guides situated in same.

The term "carrier system for products to be cooked" hereafter designates all slide-in units which are customarily used in baking ovens, such as baking sheets, grills, baking trays, etc. The interior of a baking oven or cooker is formed by the "baking-oven muffle" or muffle. If, hereafter, the term "rear" is used with respect to the baking oven, the carrier for products to be cooked or the telescopic guides, a region close to the muffle rear wall or a part which is introduced into the baking oven and brought close to the muffle rear wall is meant. "Front" designates the area close to the opening of the muffle or baking oven. "Side wall" hereafter designates the outermost limiting wall of the baking oven interior at the side. As a rule, this is the side wall of the baking-oven muffle itself. However, it can also be a wall additionally arranged in front of the actual muffle side wall in the baking oven, a block, a folded or curved sheet, a profile or another lateral fixing device, as is customary in some baking ovens.

In the case of known baking ovens, the carrier for products to be cooked is guided in grooves which are formed in the side wall. On both sides, several grooves are provided at different heights or levels, so that the carrier for products to be cooked can be introduced into the baking-oven muffle at different heights, or so that several carriers for products to be cooked can be simultaneously housed in the baking oven. In such grooves, the sliding behaviour of the carrier for products to be cooked depends on the surface condition of the surfaces sliding on one another and on the loading of the carrier for products to be cooked, and is comparatively poor. In the case of other known baking ovens, in front of the side walls, lattices are arranged with horizontal bars, on which the carriers for products to be cooked are guided. Due to the smaller bearing surface of the mostly round horizontal lattice rods, the sliding behaviour is somewhat improved compared with grooves. Both above-mentioned guiding devices for carriers for products to be cooked have the disadvantage that the carrier for products to be cooked can be withdrawn from the baking oven only up to a certain distance, without tipping downwards or having to be secured at the front. Although the upper groove limits, or further horizontal lattice rods provided at a small distance above the carrier for products to be cooked, can support the carrier for products to be cooked against tipping up to a certain withdrawal distance, and thus allow a somewhat longer withdrawal distance, a complete withdrawal of the carrier for products to be cooked as far as in front of the muffle, without the carrier for products to be cooked having to be held by a person, is however not possible with such arrangements.

In the case of improved baking ovens, fixed onto the side wall or onto a lattice are telescopic guides, on the moveable rail of which a carrier for products to be cooked can be supported. If the telescopic guides between the stationary rail and the moveable rail provided to support the carrier for products to be cooked have one or more middle rails, the telescopic guides can be withdrawn so far that the carrier for products to be cooked can be withdrawn completely from the baking oven, as far as in front of the muffle. It is moreover known that the carrier for products to be cooked supported on the moveable telescopic guide rail is moreover slideably positioned on this rail, so that after complete withdrawal of the telescopic guide it can still be pulled a further distance on the rail, as far as in front of the baking-oven muffle. This allows the use of telescopic guides with only two rails, which is advantageous for reasons of cost. The telescopic guides, due to their ease of motion, generally facilitate the withdrawal and insertion of the carrier for products to be cooked, and guarantee stability and security against a tipping of the carrier for products to be cooked when in the withdrawn position. In order to be able to house several carriers for products to be cooked in an oven, or in order to be able to position a carrier for products to be cooked at different levels, it is necessary, in the abovementioned known baking ovens for a pair of telescopic guides to be provided at each level, which again increases the costs for such baking ovens. Moreover, both the used and the unused telescopic guides take up a large amount of space in the baking-oven muffle, which impairs the air circulation in fan cookers. As telescopic guides are generally made from metal, they possess a high heat capacity. As the non-used telescopic guides in such baking ovens are also heated up, a certain quantity of thermal energy unnecessarily flows into these unused telescopic guides and thus increases the energy consumption of such baking ovens. A further disadvantage is that the telescopic guides often partially cover the illumination fitted in the baking-oven muffle at the sides, and thus impair the view inside the baking oven. Moreover, baking ovens are known, in which the telescopic guides are detachably fixed to the side wall, e.g. by means of screws. Thus the telescopic guides can, as required, be assembled and disassembled at specific levels, and the presence of non-used telescopic guides in the baking oven be avoided. If telescopic guides are not fitted at each level in the baking oven, a height adjustment of the carrier for products to be cooked is however not possible during baking or cooking in the case of such ovens. For this purpose, the telescopic guides would first have to be disassembled and reassembled at a different level. This requires a large amount of effort and is impractical and poses a handling problem, as the carrier for products to be cooked first has to be taken out of the baking oven and put down somewhere, and the telescopic guides are also heated up considerably. It would be a waste of energy and also very inexpedient for the baking or cooking process if the telescopic guides first had to be allowed to cool down for a certain period before disassembly.

A general problem associated with telescopic guides in baking ovens, is the dirtying of the telescopic guides by a product to be cooked, spraying or evaporating fat or other liquids. The dirt is not only deposited on the outsides of the telescopic guides, but also in their insides which are difficult to reach. Cleaning of the telescopic guides inside, in particular the bearing, is practically impossible, or only possible by immersing all the telescopic guides in a cleaning liquid or by pyrolytic cleaning at very high temperatures. In this case, however, lubricant or sliding agent in the bearings is in turn also removed, with the result that the telescopic guides lose their good sliding properties after being cleaned several times in this manner.

A further problem of telescopic guides in baking ovens that arises particularly in baking ovens with pyrolytic cleaning is the high temperatures which affect the lubricants or sliding agents in the bearings and can thermally degrade same. Resistant lubricants or sliding agents which at the same time guarantee good sliding properties therefore have to be permanently used at these high temperatures. Such lubricants or sliding agents are as a rule expensive. Cheaper lubricants or sliding agents with possibly even better sliding properties often cannot be used because of their thermal instability.

The object of the present invention is therefore to provide a carrier system for products to be cooked of the type initially mentioned, with which only the minimum number of telescopic guides required is present in the baking oven, and in spite of this a simpler and more comfortable changing of the levels of the carriers for products to be cooked is possible, without disassembly operations which require a large amount of effort, and the telescopic guides are less easily dirtied compared with known carrier systems for products to be cooked, and are exposed to less heat in the long term.

This object is achieved by a carrier system for products to be cooked of the type initially mentioned, with which the carrier for products to be cooked is securely or detachably connected to the pair of telescopic guides as a carrier unit for products to be cooked that is removable from the baking oven, and in the backing-oven muffle lateral intermediate walls are provided, which extend essentially perpendicularly from the muffle rear wall in the direction of the muffle opening, and are arranged such that the telescopic guides in each case extend between the side wail and the intermediate wall and the carrier for products to be cooked extends between the intermediate walls when the carrier unit for products to be cooked is inserted into the baking oven.

Each carrier for products to be cooked that is inserted into the baking oven is connected to the required pair of telescopic guides to form a carrier unit for products to be cooked. The carrier for products to be cooked and the telescopic guides are thus introduced into the baking oven and also removed again as a unit. The telescopic guides are in each case fixed laterally to the carrier for products to be cooked. The fixing can be developed non-detachably, e.g. by welding, riveting or another method. A detachable connection can be carried out by screwing, plugging, clamping, engaging or by another method. A detachable connection has the advantage that the unit comprising the carrier for products to be cooked and the telescopic guides can be broken down into these individual components in order to clean them more easily separately. Moreover, this means that a small number of telescopic guides can be used for a wide variety of carriers for products to be cooked. Customarily, no more than two to three carriers for products to be cooked are inserted into a baking oven simultaneously. However, a plurality of different types of carriers for products to be cooked for different uses is usually available, such as baking sheets, grills, drip-pans, etc., which can then be equipped with the telescopic guides as required.

The lateral intermediate walls which extend from the muffle rear wall in the direction of the muffle opening define a hollow space between themselves and the muffle side wall, which is hereafter designated "cold area". The space between the lateral intermediate walls is the actual baking space or hot area. The cold area is preferably only open towards the front, i.e. in the direction of the muffle opening. In this version, the upper, lower and rear side of the respective intermediate wall are connected to the corresponding muffle walls. It is advantageous for this connections between muffle and intermediate walls to be sealed over the entire length of the upper, lower and rear sides of the intermediate walls against an exchange of heat/gas. This guarantees that the transfer of heat from the hot area of the baking oven into the cold area is kept as low as possible. In addition, dirtying of the telescopic guides arranged in the cold area is thus prevented. This version is represented e.g. in the attached FIGS. 1 and 7. Alternatively, however, the connections between muffle and side walls can be developed such that openings remain which allow an exchange of gas. It is also expedient if the intermediate walls can be removed from the baking oven for the purpose of cleaning or the like.

In an alternative version of the invention, the intermediate wall extends in one piece parallel to the muffle side walls and to the upper and lower sides of the muffle. This version is represented e.g. in the attached FIGS. 2 and 8.

It is moreover particularly advantageous if on the baking-oven door a seal is provided which, when the baking oven is closed, is in contact at least with the intermediate walls. This prevents, or at least reduces, a transfer of heat from the hot area of the baking oven into the cold area at the muffle opening. The seal can alternatively or additionally also be provided at the front ends of the intermediate walls and/or muffle walls, and be developed such that when the baking-oven door is closed, it is in contact with same, or with a seal provided on same.

When a carrier unit for products to be cooked is inserted, the telescopic guides fixed laterally to the actual carrier for products to be cooked are introduced into the two lateral hollow spaces between the muffle side wall and the intermediate wall, i.e. into the lateral cold areas. The carrier for products to be cooked fixed between the telescopic guides is introduced into the space between the lateral intermediate walls, i.e. into the hot area. The telescopic guides are then detachably fixed to the respective side walls. Different versions of advantageous fixings of the telescopic guides are described below.

The positioning of the telescopic guides according to the invention in a space separate from the actually cooking space has several advantages. Due to the physical separation or displacement from the actual baking space of splashes from products to be cooked or fat vapours, the telescopic guides are dirtied only slightly in comparison with traditional baking oven designs, or not at all. Cleaning is therefore required considerably less often, and the sliding properties of the telescopic guides are maintained for considerably longer. In addition, the telescopic guides are less strongly heated in the cold area than the carrier for products to be cooked, with the result that lubricants and sliding agents in the bearings of the telescopic guides are exposed to lower thermal stress. Furthermore, after the carrier unit for products to be cooked is removed from the baking oven, it may already be possible to grip the telescopic guides with bare hands, although this is not yet possible for the actual carrier for products to be cooked. It is therefore expedient to develop the intermediate walls to be heat-insulating.

In order to be able to introduce the telescopic guides of a carrier for products to be cooked into the respective lateral cold areas and the carrier unit for products to be cooked into the hot area, in the case of a particularly preferred version, connections that are developed essentially U-shaped are provided between the telescopic guides and the carrier for products to be cooked. A U-shaped bracket is expedient which is fixed to the telescopic guide and laterally to the carrier for products to be cooked, wherein the part of the bracket connecting the U-bend faces the muffle opening and encloses the front side of the respective intermediate wall when the carrier unit for products to be cooked is inserted.

In a further version of the carrier system for products to be cooked according to the invention, on the front surfaces of the intermediate walls facing the baking oven opening, recesses are provided, into which the section of the carrier unit for products to be cooked connecting the telescopic guides and the carrier for products to be cooked or the part of the U-shaped bracket connecting the U-bend can be inserted. The recesses in the front surfaces of the intermediate walls have several advantages. They can be formed such that they support the carrier unit for products to be cooked in the baking oven in addition to the fixing of the telescopic guides in the front area of the oven muffle in addition, they can serve as guides when the carrier unit for products to be cooked is inserted. Moreover, the recesses in the front surfaces of the intermediate walls enable the carrier unit for products to be cooked to be inserted deeper into the oven and/or the intermediate walls to be developed such that they extend into the plane of the muffle opening or further. The intermediate walls expediently extend so far forwards that, when the baking-oven door is closed, they are in contact with same or with sealings provided on same, or only a slight gap remains. As a result, the heat transfer from the hot area into the cold area of the oven is also prevented or at least reduced.

In an alternative version, the recesses at the front surfaces of the intermediate walls are formed slit-shaped, and extend in the direction of the muffle rear wall e.g. as far as half the muffle's depth or further. Although this version offers less insulation against heat transfer from the hot area into the cold area, it allows a further direct connection between the carrier for products to be cooked and the telescopic guides in addition to the U-shaped connection in the area of the muffle opening. This additional connection can be a direct link or pin from the carrier for products to be cooked to the telescopic guide, in an area of the carrier unit for products to be cooked that is situated lower in the oven muffle. This provides an additional torsion stabilization of the connection between the carrier for products to be cooked and the telescopic guides. In this version, the recesses in the intermediate walls are at least as deep as the distance of this additional connection between the carrier for products to be cooked and the telescopic guides from the connection in the front area of the carrier for products to be cooked.

In this case, the term "inner rail" designates the moveable rail of a telescopic guide, which faces the baking-oven interior with respect to the muffle side wall. The connection between the carrier unit for products to be cooked and the telescopic guide is expediently made via the inner rail. The term "outer rail" designates the stationary rail of the telescopic guide, which in the baking-oven muffle is detachably fixed to the side walls or the fixing devices provided for this purpose.

For easy withdrawal and insertion of the carrier unit for products to be cooked during baking or cooking, according to the invention it is advantageous for the rails of the telescopic guides to be positioned and moveable against one another by means of balls, rollers or rolls, preferably with cage bearings. Although telescopic guides with rails sliding directly against each other are suitable if costs of the telescopic guides with ball-bearings are to be saved, such telescopic guides have a somewhat poorer sliding behaviour. Of course the telescopic guides according to the invention, as is customary with most telescopic guides, are provided with withdrawal limiters, in order to prevent the rails from being completely pulled apart and separated.

It is also advantageous if the telescopic guides in addition to the inner rail and the outer rail have one or more middle rails. The length of the telescopic guides is limited by the depth of the baking-oven interior and therefore corresponds approximately to the depth of the used carrier unit for products to be cooked. Longer telescopic guides would prevent closing of the baking-oven door. The withdrawal of two telescopic guides opposite one another up to the withdrawal limit therefore corresponds at most to the length of the respective rails, reduced by the space taken up by the balls, rollers or rolls between the rails. The better the sliding behaviour of the telescopic guides is to be, the more balls, rollers or rolls are provided. If the carrier for products to be cooked cannot be slid still further forwards on the telescopic guides, as is known from the state of the art, a withdrawal of the carrier for products to be cooked as far as in front of the baking-oven muffle can only be realized with telescopic guides which have three or more rails.

The fixing devices for the telescopic guides can be openings, slits or recesses provided in the side walls, into which the telescopic guides are suspended, engaged, or otherwise fixed. Moreover, fixing devices can be lattices or folded sheets, arranged in front of the side walls, with corresponding openings, slits or recesses.

In a particularly preferred version of the carrier system for products to be cooked according to the invention, side-wall guides are provided on the muffle side walls with guide surfaces or guide bevels running obliquely in the direction of the muffle rear wall. Such side-wall guides with guide bevels facilitate the insertion of the carrier unit for products to be cooked into the baking oven, without the operative having to take precise aim at a holder or similar in the rear baking-oven space, and serve as a bearing surface for the carrier unit for products to be cooked. The guide bevels can guide on one side, e.g. only from below, to the correct positioning height of the carrier unit for products to be cooked. However, it is advantageous if the guiding is provided from above and from below.

The fixing of the telescopic guides in the baking-oven muffle can essentially be carried out in any manner, insofar as this allows a withdrawal of both telescopic guides, together with the carrier for products to be cooked connected to same, as a carrier unit for products to be cooked, without disassembly operations which require a large amount of effort. Two versions of fixings of the telescopic guides in the baking-oven muffle, which are particularly preferred according to the invention, are hereafter designated "variant with bolt fastening" and "variant with hooks" respectively. These two versions of the fixings, as well as further advantages, features and versions of the invention are explained with reference to the following description of the attached figures. The version "variant with bolt fastening" is also described in German Patent Application DE 19951267.2 of Accuride International GmbH, application date 25 Oct. 1999, the content of which is also a subject of this description by way of reference.

Variant with Hooks (FIGS. 1 to 6)

Figure 1:
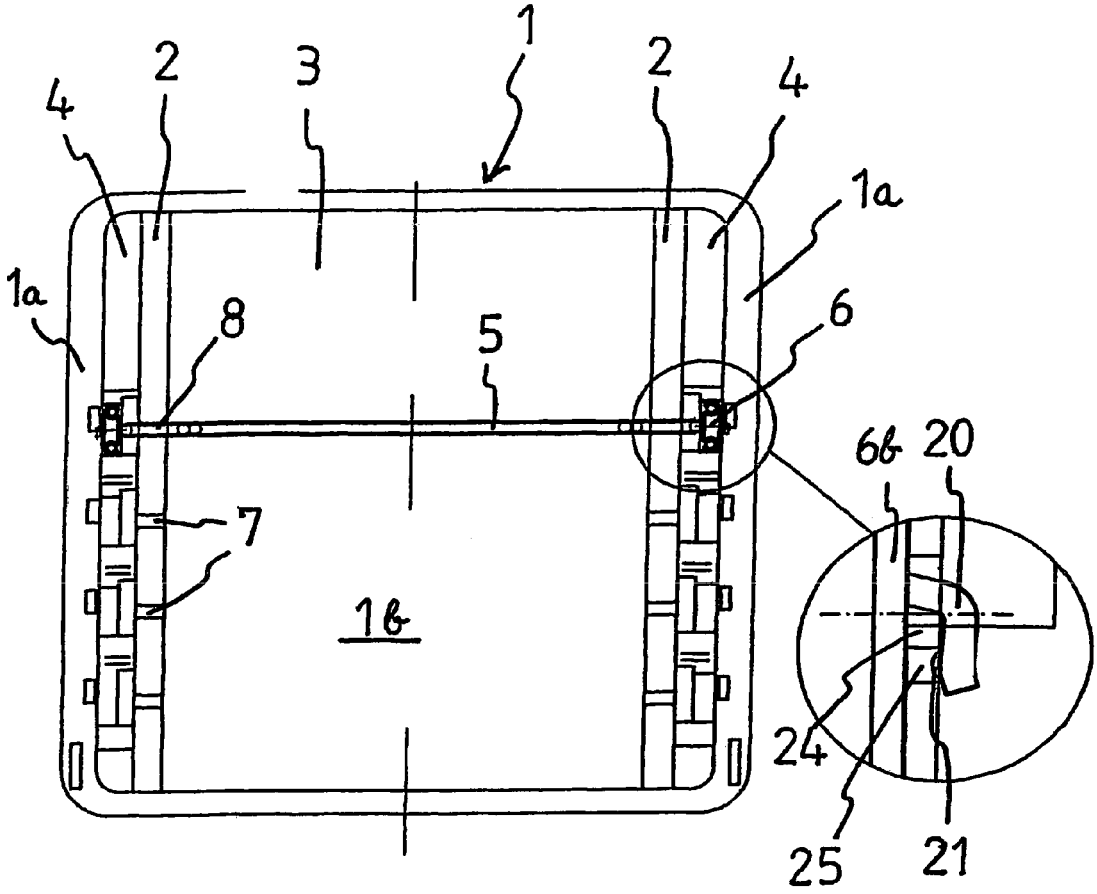
FIG. 1 shows a front view of a baking-oven space with lateral intermediate walls, with inserted carrier unit for products to be cooked and with fixings of the telescopic guides in the baking-oven muffle according to the "variant with hooks".
Figure 3:
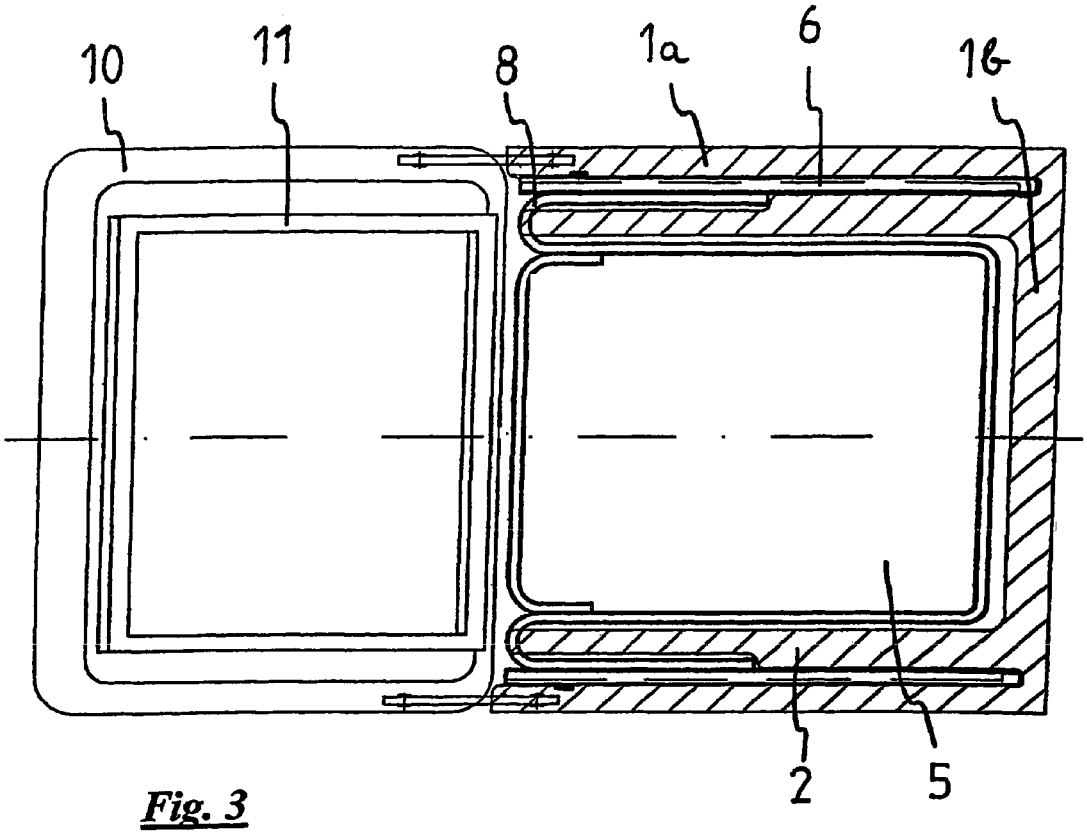
FIG. 3 shows a sectional view of the baking oven of FIG. 1 or FIG. 2 with opened baking-oven door and with inserted carrier unit for products to be cooked, from above.
Figure 5:
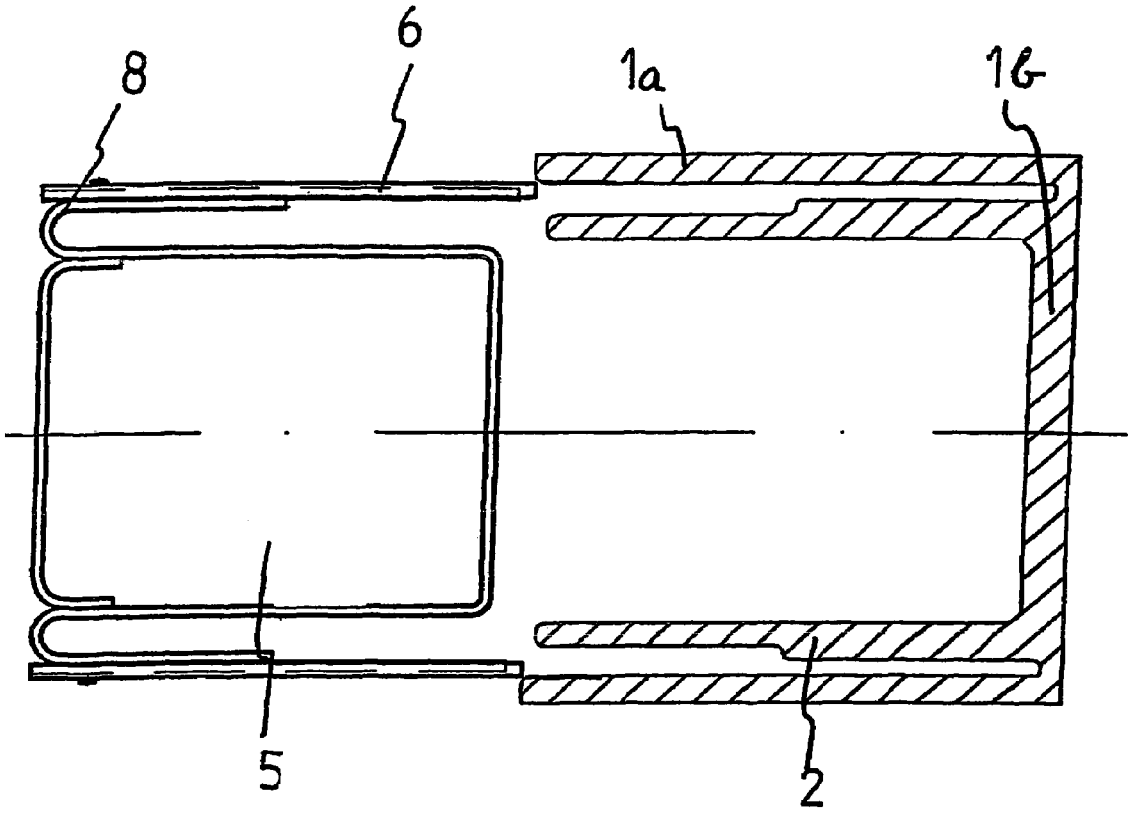
FIG. 5 shows on the left side the carrier unit for products to be cooked of FIG. 3 from above and separate from the baking oven and on the right side the sectional view of the baking-oven space of FIG. 3 without baking-oven door, from above.

FIG. 1 shows a baking-oven muffle with muffle side walls 1*a* and a muffle rear wall 1*b*. In each case, intermediate walls 2 are arranged in front of the muffle side walls 1*a*. The intermediate walls extend essentially perpendicularly from the muffle rear wall 1*b* in the direction of the muffle opening, as shown by FIGS. 3 and 5. Moreover, the intermediate walls 2 extend in a vertical direction from the upper muffle wall as far as the lower muffle wall or the muffle floor. In each case, an intermediate wall 2 and a muffle side wall 1*a*, together with a section of the upper and lower muffle wall, delimit a cold area 4. The area delimited by the two intermediate walls 2 and the upper and lower muffle wall is the actual cooking space or hot area 3.

Figure 2:
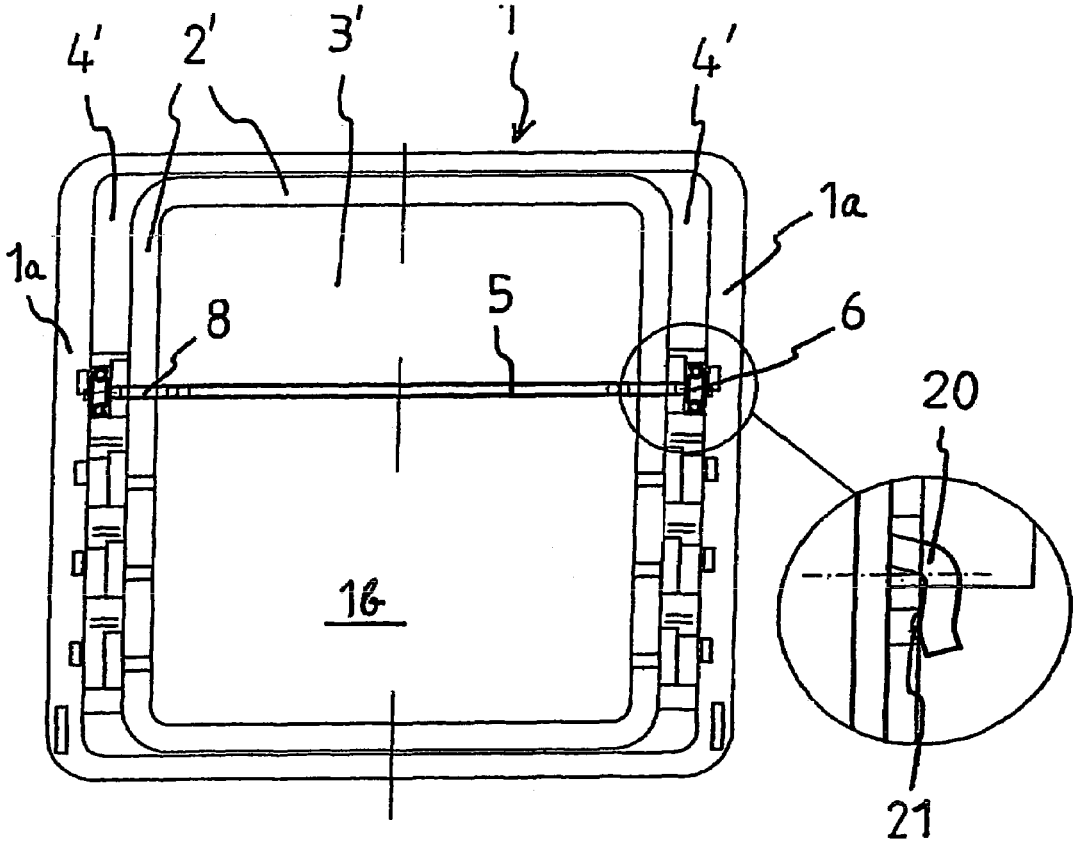
FIG. 2 shows a front view of a baking-oven space similar to that in FIG. 1 with an alternative version of the intermediate walls, with inserted carrier unit for products to be cooked and with fixings of the telescopic guides in the baking-oven muffle according to the "variant with hooks".

In an alternative version according to FIG. 2, the intermediate wall 2' is formed in one piece. In this case, it does not end at the upper and lower muffle wall respectively, but is continued parallel to same as far as the opposite lateral intermediate wall 2'. The cold and hot areas delimited by the intermediate wall 2 and the muffle wall are designated 4' and 3' in FIG. 2.

Figure 4:
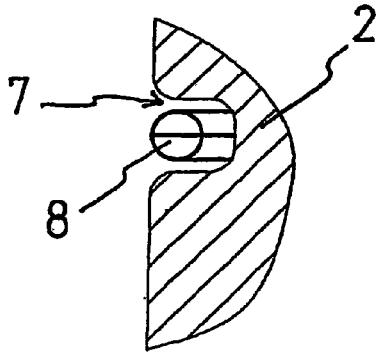
FIG. 4 shows a broken-off side view of the intermediate wall of FIG. 1 or FIG. 2 with a recess for the accommodation of the connecting piece connecting the telescopic guide and the carrier for products to be cooked.
Figure 6:
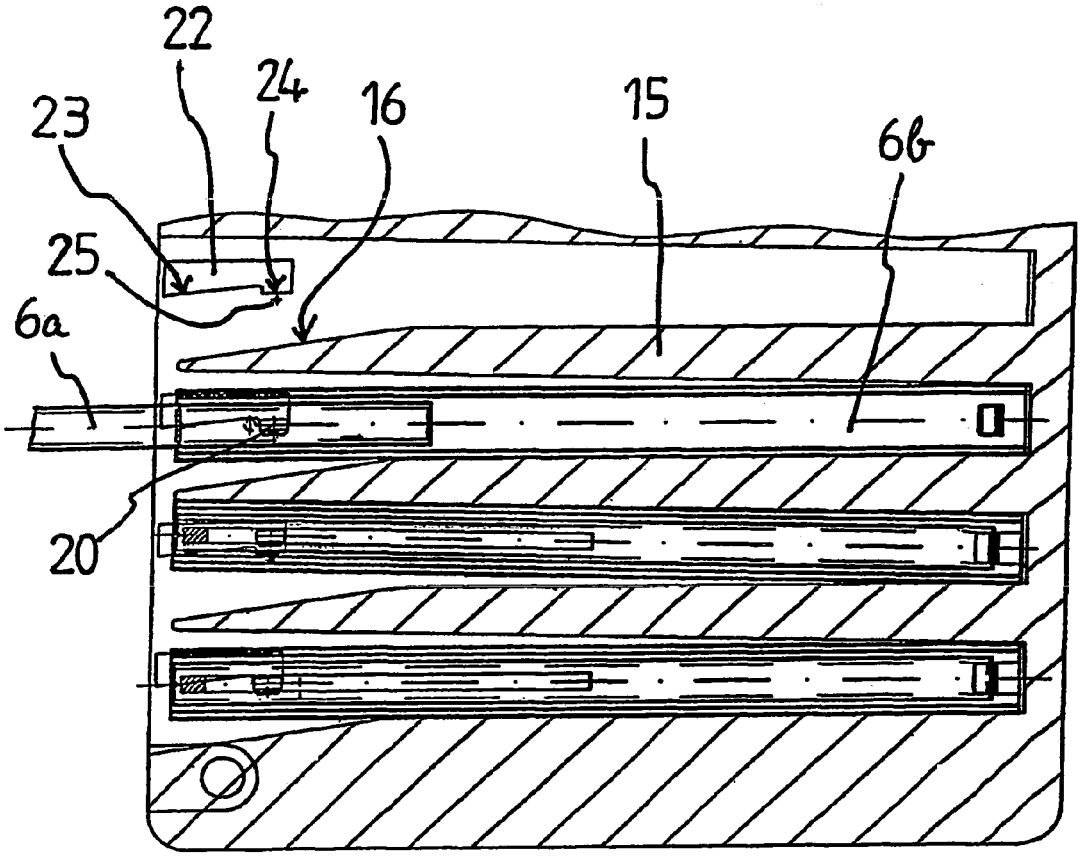
FIG. 6 shows a view of the left side wall of the baking oven of FIG. 1 or FIG. 2.

In the baking-oven muffle 1, a carrier unit for products to be cooked according to the invention, consisting of a carrier for products to be cooked 5 and two telescopic guides 6 is inserted. The telescopic guides 6 in each case have an inner rail 6*a* and an outer rail 6*b*, as shown by FIG. 6. Inner rail 6*a* and outer rail 6*b* are positioned moveably against one another by means of ball bearings. The carrier for products to be cooked 5 is connected via connecting pieces 8 on both sides in each case with the inner rail 6*a* of a telescopic guide 6. As shown by FIGS. 3 and 5, the connecting pieces 8 arranged on both sides of the carrier for products to be cooked are developed U-shaped. When the carrier unit for products to be cooked is inserted into the baking oven, the telescopic guides 6 are situated in the cold area 4 or 4' and the carrier for products to be cooked 5 in the hot area 3 or 3'. The intermediate walls 2 or 2' at their front surfaces have recesses 7, into which the connecting pieces 8 between the carrier for products to be cooked 5 and the telescopic guides 6 are pushed during insertion of the carrier unit for products to be cooked. FIG. 4 shows a detailed view of such a recess 7 in the side wall 2 or 2'.

FIG. 6 shows a view of the left muffle side wall 1*a* of the baking oven of FIG. 1 or 2. On the muffle side walls 1*a*, side wall guides 15 projecting from same are provided, which form grooves for the accommodation of the telescopic guides 6. The grooves taper in the direction from the muffle opening towards the muffle rear wail. Close to the muffle opening, the side wall guides 15 have guide bevels 16.

FIGS. 1 and 2 each show on the right side, a detailed view in the area of the fixing of the telescopic guide 6 to the side wall. On the outer rail 6*b* of the telescopic guide 6, a hook 20 is provided, which protrudes from the outer rail 6*b* in the direction of the side wall and is curved downwards. At its lower end, the hook has a stamped part 21. As shown by FIG. 6, a side wall recess 22 with a guide bevel 23 and a hook restraint 24 is provided in the side wall. Moreover, below the hook restraint 24 there is an opening or depression 25 in the side wall. During insertion of the carrier unit for products to be cooked, the hook 20 is guided in the side wall recess 22 via the guide bevels 23 until it is over the hook restraint 24 and then pushed downwards. The distance between the outer rail 6*b* of the telescopic guide 6 and the stamped part 21 on the hook 20, vis-à-vis the thickness of the side wall in the area of the hook restraint 24, is dimensioned such that a certain force is to be applied in order to push the hook 20 over the hook restraint. In the end position, the stamped part 21 on the hook 20 engages in the opening or depression 25 in the side wall. The shape of the side wall recess 22 and the force-locking engagement of the hook 20 in the opening or depression 25 lock the outer rail 6*b* of the telescopic guide 6 against a horizontal movement and an inadvertent lifting and unlocking of the carrier for products to be cooked. In order to withdraw the carrier unit for products to be cooked from the baking oven, the hook 20 is first to be disengaged from the opening or depression 25 by lifting. Then the whole carrier unit for products to be cooked is withdrawn forwards out of the baking oven.

FIG. 6 shows four fixing levels for the carrier unit for products to be cooked according to the invention. The highest level is empty. At the second and fourth levels from the top, the left-hand telescopic guide 6 of an inserted carrier unit for products to be cooked is represented, the hook 20 being engaged in the hook restraint 24. At the second level from the top, the inner rail 6*a* of the telescopic guide is partly withdrawn, and at the fourth level it is pushed in. At the third level from the top, the carrier unit for products to be cooked or the telescopic guide 6 is lifted and unlocked, as is required for the insertion or withdrawal of the carrier unit for products to be cooked according to the invention.

Variant with Bolt Fastening (FIGS. 7 to 11)

Except for the fixings of the telescopic guides in the baking-oven muffle, the versions of FIGS. 7 to 11 correspond to those of FIGS. 1 to 6. The same reference numbers are therefore used for the same parts, and reference is made to the explanations above.

Figure 7:
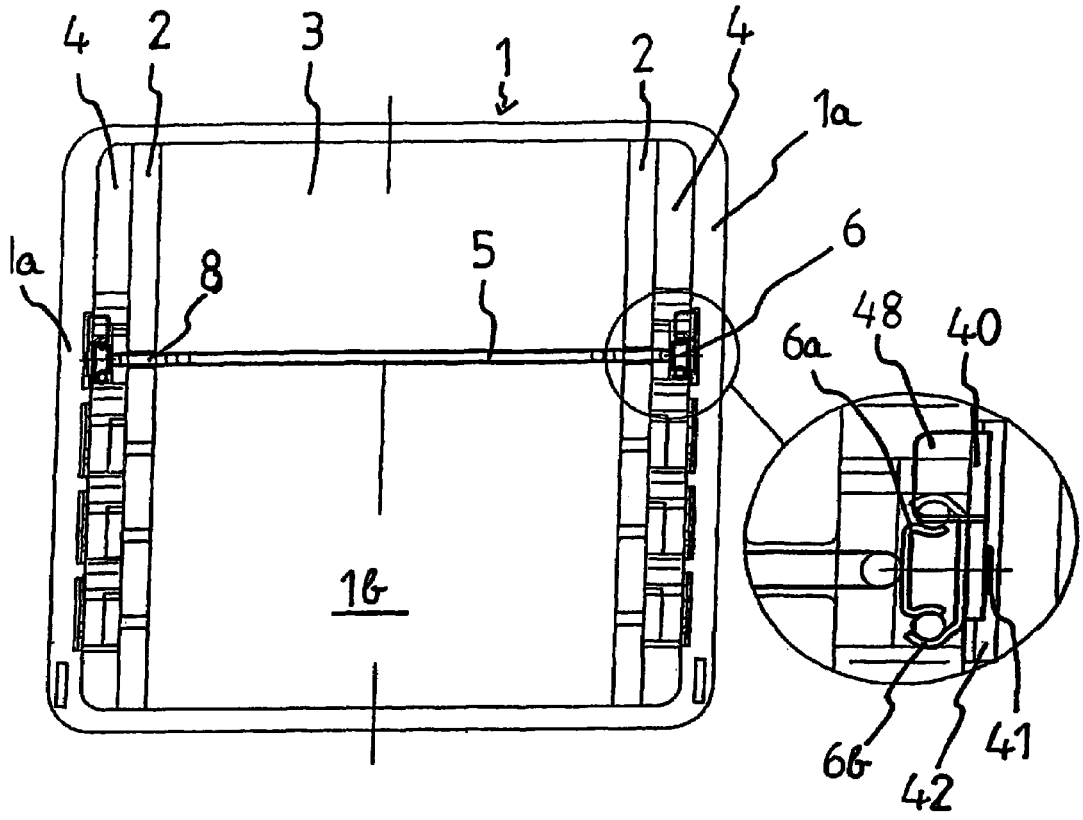
FIG. 7 shows a front view of a baking oven space with lateral intermediate walls, with inserted carrier unit for products to be cooked and with fixings of the telescopic guides in the baking-oven muffle according to the "variant with bolt fastening".
Figure 8:
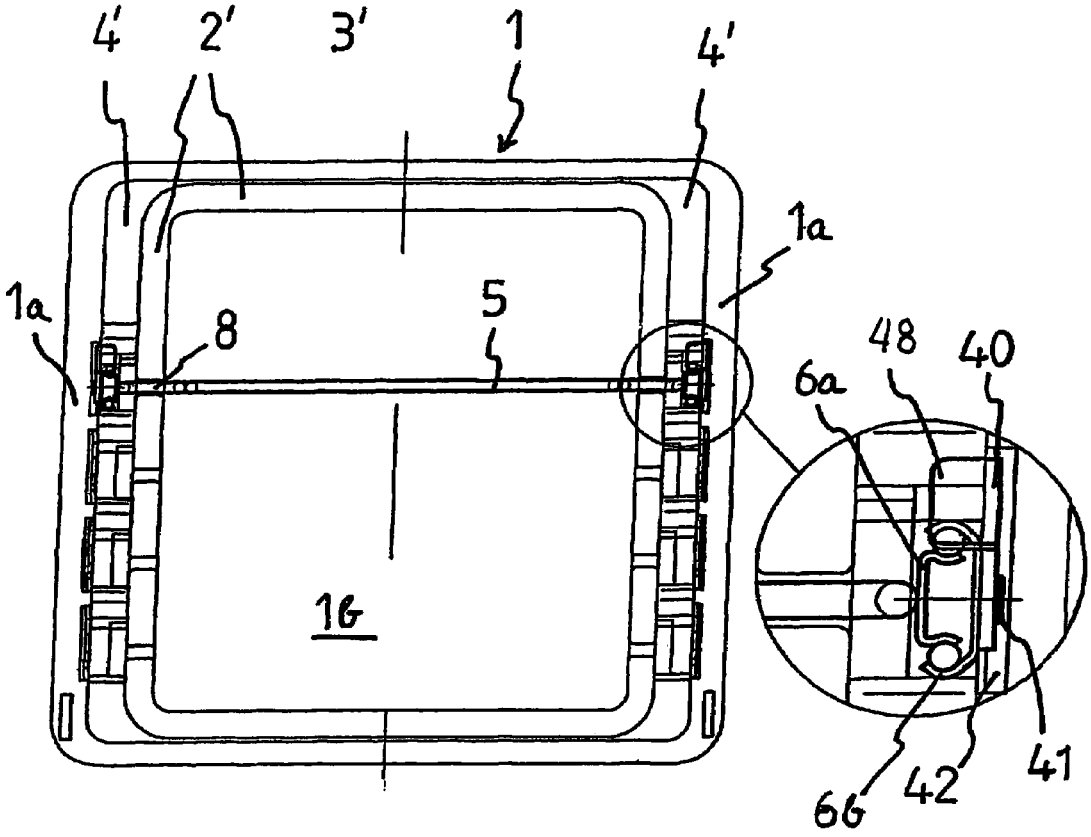
FIG. 8 shows a front view of a baking oven space similar to that of FIG. 7 with an alternative version of the intermediate walls, with inserted carrier unit for products to be cooked, and with fixings of the telescopic guides in the baking-oven muffle according to the "variant with bolt fastening".
Figure 9:
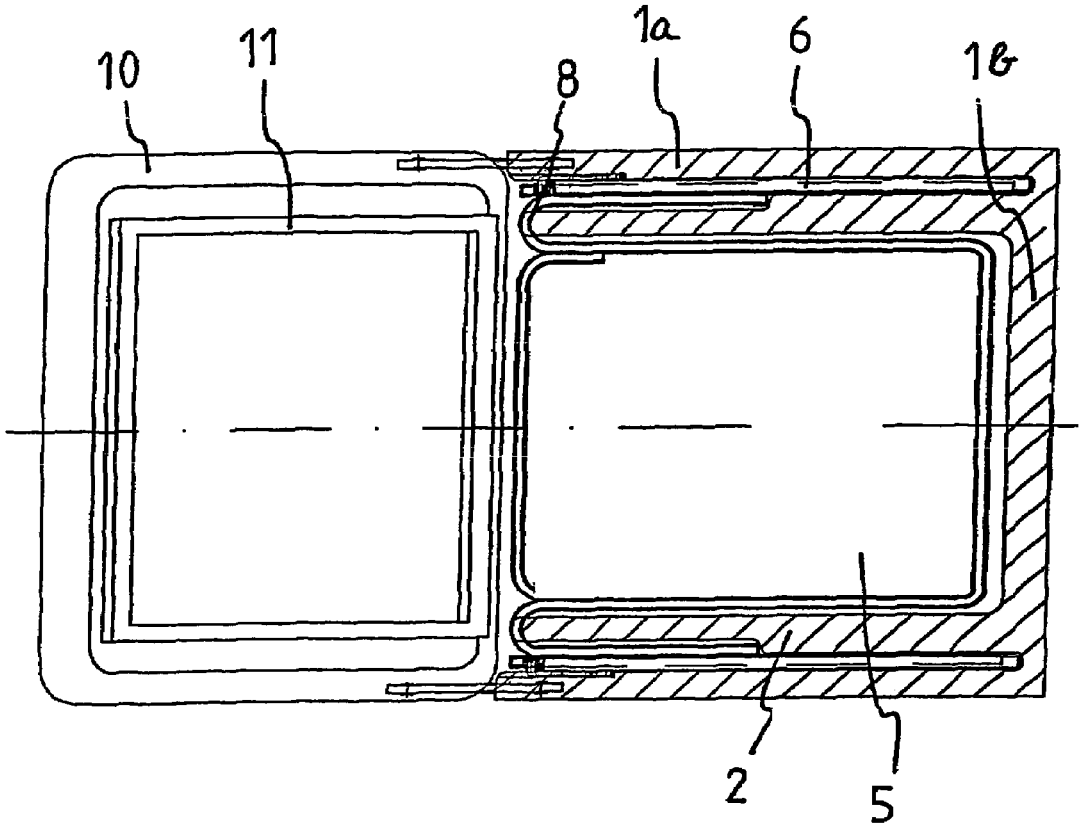
FIG. 9 shows a sectional view of the baking oven of FIG. 7 or FIG. 8 with opened baking-oven door and with inserted carrier unit for products to be cooked, from above.
Figure 10:
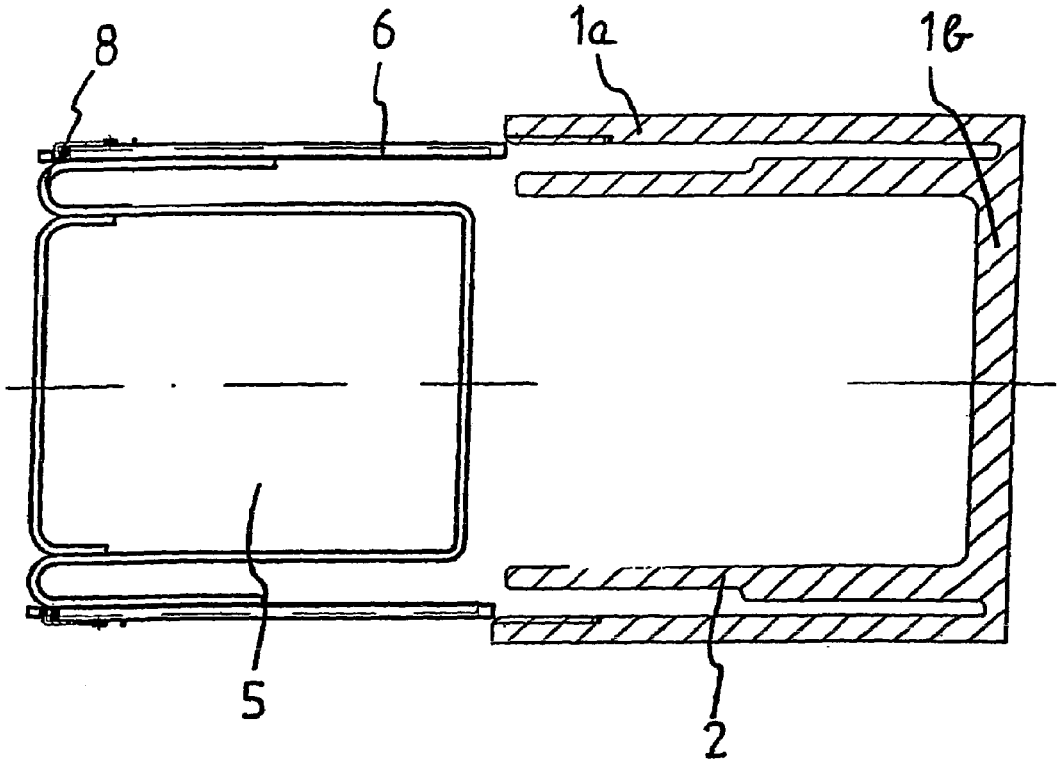
FIG. 10 shows on the left side the carrier unit for products to be cooked of FIG. 9 from above, and separate from the baking oven, and on the right side the sectional view of the baking-oven space of FIG. 9 from above.
Figure 11:
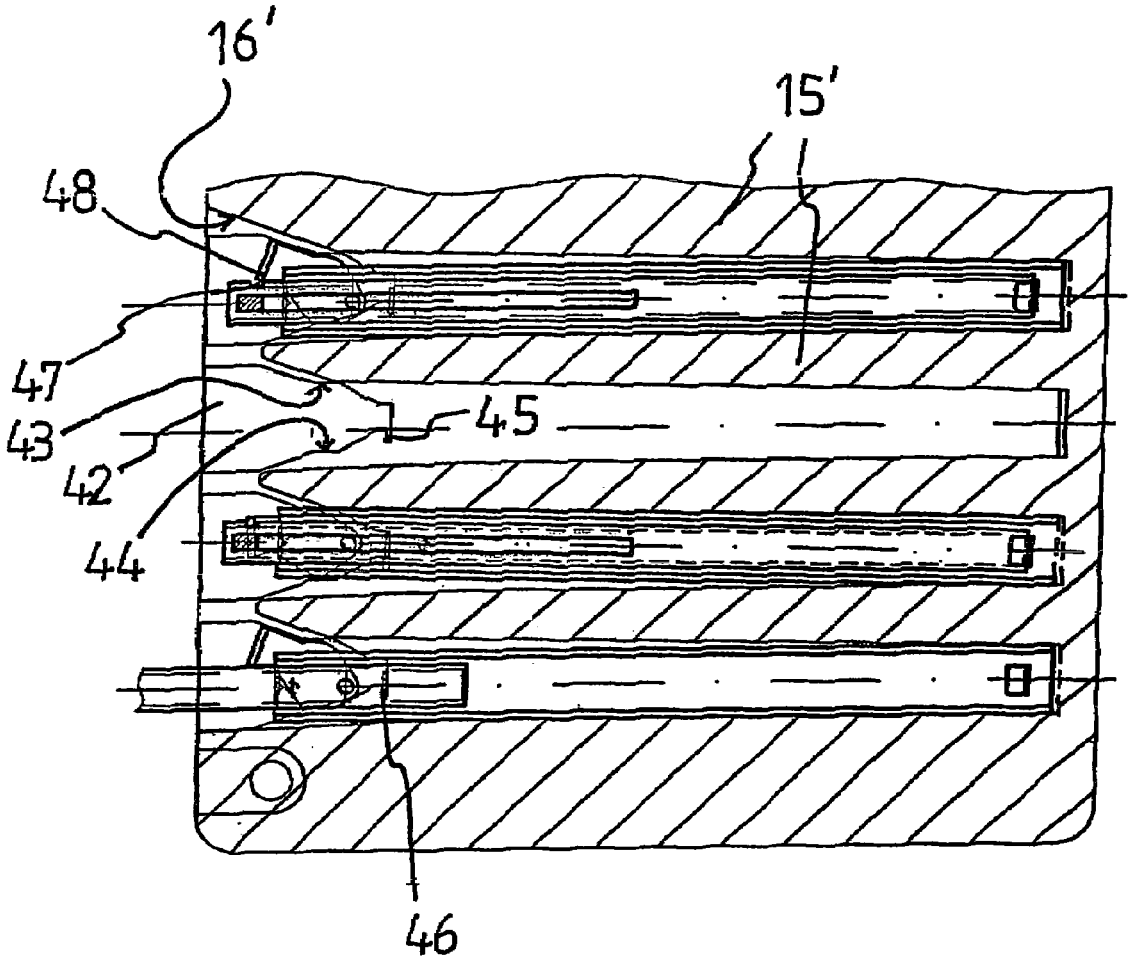
FIG. 11 shows a view of the left side wall of the baking oven of FIG. 7 or FIG. 8.

FIGS. 7 and 8 each show, on the right side, a detailed view in the area of the fixing of the telescopic guide 6 to the side wall. A bolt 40 is rotatably fixed via a hinged bolt 41 to the outer rail 6*b*. Moreover, the outer rail 6*b* has a fish plate 46 which projects essentially perpendicularly from the outer rail 6*b*. FIG. 11 shows a view of the left muffle side wall 1*a* of the baking oven of FIG. 7 or 8. On the muffle side walls 1*a*, side wall guides 15' projecting from same are provided which form grooves for the accommodation of the telescopic guides 6. The grooves taper in the direction from the muffle opening towards the muffle rear wall. Close to the muffle opening, the side wall guides 15' have guide bevels 16'.

Side wall recesses 42 in the muffle side walls 1*a* in the area of the muffle opening are part of the fixing device for the telescopic guides 6. The side wall recesses 42 each have an upper stop 43 and a lower stop 44 for the bolt 40 of the telescopic guides 6. Moreover, a slit-shaped restraint 45 is provided in the side wall recesses 42.

FIG. 11 shows four fixing levels for the carrier unit for products to be cooked according to the invention. At the highest level, the left-hand telescopic guide 6 of an inserted carrier unit for products to be cooked is represented, the inner rail 6*a* of the telescopic guide 6 being completely pushed in. The second level from the top is empty. At the third level from the top, the carrier unit for products to be cooked or the telescopic guide 6 is lifted, as is required for the insertion or withdrawal of the carrier unit for products to be cooked according to the invention. At the fourth level from the top, the left-hand telescopic guide 6 of an inserted carrier unit for products to be cooked with withdrawn inner rail 6*a* is shown.

The two positions of the bolt 40 of the carrier unit for products to be cooked according to the invention are represented in FIG. 11. At the highest and lowest level, the bolt 40 is in an unlocking position which it occupies when the carrier unit for products to be cooked is inserted into the baking oven and the outer rail 6*b* is locked against horizontal movement by engaging the fish plate 46 on the outer rail 6*b* in the slit-shaped restraint 45.

At the third level from the top, the bolt 40 is in a locking position which it occupies when the carrier unit for products to be cooked is lifted for insertion or withdrawal. The inner rail 6*a* has a notch 47 for the bolt 40, in which a latch 48 provided on the bolt 40 can engage, in order to lock the outer rail 6*b* and the inner rail 6*a* against a movement against one another. In order to bring the bolt 40 into this locking position, the notch 47 on the inner rail 6*a* must first be brought under the latch 48, i.e. the inner rail 6*a* must be pushed into the telescopic guide 6, as shown in the case of the highest of the telescopic guides 6 represented in FIG. 11. The locking of the inner rail 6*a* against the outer rail 6*b* is carried out by lifting the carrier unit for products to be cooked at the front, the fish plate 46 being lifted out of the slit-shaped restraint 45 and thus the outer rail 6*b* being released from its locking position against horizontal withdrawal from the baking oven. The bolt 40 has an upper stop surface which, when the carrier unit for products to be cooked is lifted, is pushed against the upper stop 43 of the side wall recess 42, the bolt 40 rotating about the hinged bolt 41 and the latch 48 entering into the notch 47 on the inner rail. The whole carrier unit for products to be cooked, consisting of a carrier for products to be cooked 5 and telescopic guides 6, can then be withdrawn from the baking oven, without the rails of the telescopic guides 6 sliding apart. The insertion of the carrier unit for products to be cooked is carried out the other way around, a lower stop surface of the bolt 40 being pushed, during the lowering of the carrier unit for products to be cooked, against the lower stop 44 of the side wall recess 42. The bolt 40 rotates about the hinged bolt 41, and the latch 48 lifts out of the notch 47 on the inner rail 6*a*, releasing same. At the same time, the fish plate 46 provided on the outer rail 6*b* is lowered into the slit-shaped restraint 45, so that the outer rail 6*b* is locked against a horizontal movement out of the baking oven. During withdrawal of the carrier for products to be cooked as far as in front of the baking oven, there is therefore no risk that the whole carrier unit for products to be cooked will be pulled out of the oven together with the telescopic guides. Inadvertent unlocking, i.e. lifting of the fish plate 46 out of the restraint 45, is prevented in that, when the inner rail 6*a* is withdrawn, the bolt 40 is in the unlocking position and is kept therein, as the latch 48 cannot dip into the notch 47 on the inner rail 6*a*, but comes to lie on the upper edge of the inner rail 6*a*. In this position, the upper stop surface of the bolt 40 is situated close to or directly against the upper stop 43 of the side wall recess 42, which prevents lifting of the whole carrier unit for products to be cooked and unlocking of the fish plate.

The side wall recesses 42 can be provided in the muffle side wall 1*a* itself. Alternatively, a fixing device developed as a profile or folded sheet can be provided on the muffle side wall 1*a* as a side wall with the corresponding recesses. The side wall recesses 42 allow access from the front.

LIST OF REFERENCE NUMBERS

1 Baking-oven muffle
1*a* Muffle side wall
1*b* Muffle rear wall
2, 2' Intermediate wall
3, 3' Hot area
4, 4' Cold area
5 Carrier for products to be cooked
6 Telescopic guide
6*a* Inner rail of the telescopic guide
6*b* Outer rail of the telescopic guide
7 Recesses on the front/sealing surfaces of the intermediate wall
8 Connecting piece between the carrier for products to be cooked and the telescopic guide
10 Baking-oven door
11 Seal on the baking-oven door
15, 15' Side wall guide
16, 16' Guide bevels on the side wall guide
20 Hook
21 Stamped part on the hook
22 Side wall recess
23 Guide bevels on the side wall recess
24 Hook restraint
25 Opening/depression in the side wall
40 Bolt
41 Hinged bolt
42 Side wall recess
43 Upper stop in the side wall recess
44 Lower stop in the side wall recess

45 Slit-shaped restraint
46 Fish plate on the outer rail
47 Notch on the inner rail
48 Latch

The invention claimed is:

1. Carrier system for products to be cooked in a baking oven with at least one carrier for products to be cooked (5) having a baking-oven muffle (1) for the baking-oven, the baking-oven muffle having muffle side walls (1*a*), a muffle rear wall (1*b*) and a muffle opening, the carrier for products to be cooked (5) being provided with at least one pair of telescopic guides (6) which each have at least one inner rail (6*a*) and one outer rail (6*b*) and fixing devices which are arranged on the muffle side walls (1*a*) of the baking-oven muffle (1), and which are designed for a detachable fixing of the at least one pair of telescopic guides (6) at various levels of the baking-oven muffle (1), the carrier for products to be cooked (5) being positioned in such a way that the carrier for products to be cooked (5) can be removed from the baking-oven muffle (1) by means of the at least one pair of telescopic guides (6) situated in the carrier for products to be cooked (5), characterized in that:

the carrier for products to be cooked (5) is securely connected to the at least one pair of telescopic guides (6), the carrier for products to be cooked (5) and the at least one pair of telescopic guides (6) together along with the carrier for products to be cooled are removable from the baking oven as a combined carrier unit for products to be cooked, and and in the baking-oven muffle (1) intermediate walls (2, 2') are provided which extend essentially perpendicularly from the muffle rear wall (1*b*) in the direction of the muffle opening such that the intermediate walls (2, 2') extend between a cold area and a hot area, and are arranged such that the at least one pair of telescopic guides (6) in each case extend between each of the muffle side walls (1*a*) and the corresponding intermediate wall (2, 2'), the cold area extending between each of the muffle side walls (1*a*) and the corresponding intermediate wall (2, 2'), and the carrier for products to be cooked (5) extends between the intermediate walls (2, 2'), the hot area extending between the intermediate walls (2, 2'), when the carrier unit for products to be cooked (5) is inserted into the baking oven.

2. Carrier system for products to be cooked according to claim 1, characterized in that connecting pieces (8) that are essentially U-shaped are provided between the at least one pair of telescopic guides (6) and the carrier for products to be cooked (5).

3. Carrier system for products to be cooked according to one of claims 1 or 2, characterized in that the intermediate walls (2, 2') are heat-insulating.

4. Carrier system for products to be cooked according to one of claims 1 to 2, characterized in that recesses (7) are provided on a front surface of the intermediate walls (2, 2') facing the muffle opening.

5. Carrier system for products to be cooked according to one of claims 1 to 2, characterized in that the at least one inner rail (6*a*) and one outer rail (6*b*) of the at least one pair of telescopic guides (6) are supported and moveable against one another by means of balls, rollers, rolls, or cage bearings.

6. Carrier system for products to be cooked according to one of claims 1 to 2, characterized in that the at least one pair of telescopic guides (6), in addition to the inner rail (6*a*) and the outer rail (6*b*) have one or more middle rails.

7. Carrier system for products to be cooked in a baking oven with at least one carrier for products to be cooked (5) having a baking-oven muffle (1) for the baking-oven, the baking-oven muffle having muffle side walls (1*a*), a muffle rear wall (1*b*) and a muffle opening, the carrier for products to be cooked (5) being provided with at least one pair of telescopic guides (6) which each have at least one inner rail (6*a*) and one outer rail (6*b*) and fixing devices which are arranged on the muffle side walls (1*a*) of the baking-oven muffle (1), and which are designed for a detachable fixing of the at least one telescopic guides (6) at various levels of the baking-oven muffle (1), the carrier for products to be cooked (5) being positioned in such a way that the carrier for products to be cooked (5) can be removed from the baking-oven muffle (1) by means of the at least one pair of telescopic guides (6) situated in the carrier for products to be cooked (5), characterized in that:

the carrier for products to be cooked (5) is detachably connected to the at least one pair of telescopic guides (6), the carrier for products to be cooked (5) and the at least one pair of telescopic guides (6) together along with the carrier for products to be cooled are removable from the baking oven as a combined carrier unit for products to he cooked, and in the baking-oven muffle (1) intermediate walls (2, 2') are provided which extend essentially perpendicularly from the muffle rear wall (1*b*) in the direction of the muffle opening such that the intermediate walls (2, 2') extend between a cold area and a hot area, and are arranged such that the at least one pair of telescopic guides (6) in each ease extend between each of the muffle side walls (1*a*) and the corresponding intermediate wall (2, 2'), the cold area extending between each of the muffle side walls (1*a*) and the corresponding intermediate wall (2, 2') and the carrier for products to be cooked (5) extends between the intermediate walls (2, 2'), the hot area extending between the intermediate walls (2, 2'), when the carrier unit for products to be cooked (5) is inserted into the baking oven.

8. Carrier system for products to be cooked according to claim 7, characterized in that connecting pieces (8) that are essentially U-shaped are provided between the at least one pair of telescopic guides (6) and the carrier for products to be cooked (5).

9. Carrier system for products to be cooked according to one of claims 7 or 8, characterized in that the intermediate walls (2, 2') are heat-insulating.

10. Carrier system for products to be cooked according to one of claims 7 to 8, characterized in that recesses (7) arc provided on a front surface of the intermediate walls (2, 2') facing the muffle opening.

11. Carrier system for products to be cooked according to one of claims 7 to 8, characterized in that the at least one inner rail (6*a*) and one outer rail (6*b*) of the at least one pair of telescopic guides (6) are supported and moveable against one another by means of balls, rollers, rolls, or cage bearings.

12. Carrier system for products to be cooked according to one of claims 7 to 8, characterized in that the at least one pair of telescopic guides (6), in addition to the inner rail (6*a*) and the outer rail (6*b*) have one or more middle rails.

* * * * *